US011703268B2

(12) United States Patent
Kim et al.

(10) Patent No.: US 11,703,268 B2
(45) Date of Patent: Jul. 18, 2023

(54) REFRIGERATOR AND CONTROL METHOD THEREOF

(71) Applicant: Samsung Electronics Co., Ltd, Suwon-si (KR)

(72) Inventors: Min Soo Kim, Suwon-si (KR); Hee Moon Jeong, Suwon-si (KR); Kook Jeong Seo, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 611 days.

(21) Appl. No.: 16/698,709

(22) Filed: Nov. 27, 2019

(65) Prior Publication Data

US 2020/0173708 A1 Jun. 4, 2020

(30) Foreign Application Priority Data

Nov. 28, 2018 (KR) ..... 10-2018-0149880

(51) Int. Cl.
*F25D 21/00* (2006.01)
*F25D 21/08* (2006.01)
*F25D 11/02* (2006.01)

(52) U.S. Cl.
CPC ..... *F25D 21/006* (2013.01); *F25D 11/02* (2013.01); *F25D 21/08* (2013.01); *F25D 2600/02* (2013.01)

(58) Field of Classification Search
CPC ..... F25D 21/08; F25D 17/065
See application file for complete search history.

(56) References Cited

U.S. PATENT DOCUMENTS 3,899,895 A * 8/1975 Blanton ..... F25D 17/065 62/158
6,694,754 B1 2/2004 Schenk et al.
3,033,124 A1 10/2011 Han et al.
10,612,832 B2 4/2020 Iwamoto et al.
(Continued)

FOREIGN PATENT DOCUMENTS

CN 101545707 A 9/2009
CN 106568251 A 4/2017
(Continued)

OTHER PUBLICATIONS

International Search Report dated Mar. 23, 2020 in connection with International Patent Application No. PCT/KR2019/016239, 3 pages.
(Continued)

*Primary Examiner* — Jianying C Atkisson
*Assistant Examiner* — Meraj A Shaikh

(57) ABSTRACT

A refrigerator including a main body including a storeroom; an evaporator arranged in the back of the storeroom and configured to generate cold air; a defrost heater arranged under the evaporator into which air flows and configured to remove frost or ice formed on the evaporator; a temperature sensor arranged on the top of the evaporator and configured to measure temperature; and a controller configured to stop operation of the defrost heater in a first defrost cycle based on a first measurement measured by the temperature sensor and stop operation of the defrost heater in a second defrost cycle based on a second measurement, which is different from the first measurement.

9 Claims, 21 Drawing Sheets

(56) References Cited

U.S. PATENT DOCUMENTS

| | | | | |
|---|---|---|---|---|
| 2005/0217286 | A1* | 10/2005 | Jeong | F25D 21/08 62/151 |
| 2006/0117768 | A1 | 6/2006 | Lee et al. | |
| 2007/0000271 | A1* | 1/2007 | Lee | F25D 21/08 62/276 |
| 2013/0081416 | A1* | 4/2013 | Kim | F25D 21/006 62/151 |
| 2013/0160471 | A1* | 6/2013 | Worley | F25D 21/006 62/81 |
| 2015/0047375 | A1 | 2/2015 | Qu et al. | |
| 2018/0010843 | A1 | 1/2018 | Eom et al. | |
| 2021/0071932 | A1* | 3/2021 | Roslindo | F25D 21/08 |
| 2021/0207874 | A1* | 7/2021 | Lee | F25D 21/004 |

FOREIGN PATENT DOCUMENTS

| | | | |
|---|---|---|---|
| CN | 108369052 | A | 8/2018 |
| EP | 2574868 | A2 | 4/2013 |
| JP | H04-106387 | A | 4/1992 |
| JP | 2009-092371 | A | 4/2009 |
| JP | 2017-110857 | A | 6/2017 |
| JP | 2018-179323 | A | 11/2018 |
| KR | 2004-0069635 | A | 8/2004 |
| KR | 10-1373568 | B1 | 3/2014 |
| KR | 10-2018-0062097 | A | 6/2018 |
| WO | 2015/129315 | A1 | 9/2015 |

OTHER PUBLICATIONS

European Search Report dated Apr. 20, 2020 in connection with European Patent Application No. 19 21 1301, 10 pages.

European Patent Office, "Communication pursuant to Article 94(3) EPC" dated Apr. 14, 2022, in connection with European Patent Application No. 19211301.7, 6 pages.

Office Action dated Oct. 11, 2022 in connection with Chinese Patent Application No. 201980078641.X, 14 pages.

Office Action dated Jan. 3, 2023 in connection with Indian Patent Application No. 202117018614, 7 pages.

* cited by examiner

FIG. 9

(a)

| DEFROST CYCLE | CONVENTIONAL CASE | | | | PERIODICITY : 2 | | | |
|---|---|---|---|---|---|---|---|---|
| | DEFROSTING | DURATION (Min) | ENERGY (Wh) | ACCUMULATED ENERGY (Wh) | DEFROSTING | DURATION (Min) | ENERGY (Wh) | ACCUMULATED ENERGY (Wh) |
| 1 | FULL | 23 | 52 | 52 | PARTIAL | 16 | 36 | 36 |
| 2 | FULL | 23 | 52 | 104 | FULL | 23 | 32 | 88 |
| | | ... | | | | ... | | (-15%) |

(b)

| DEFROST CYCLE | CONVENTIONAL CASE | | | | PERIODICITY : 3 | | | |
|---|---|---|---|---|---|---|---|---|
| | DEFROSTING | DURATION (Min) | ENERGY (Wh) | ACCUMULATED ENERGY (Wh) | DEFROSTING | DURATION (Min) | ENERGY (Wh) | ACCUMULATED ENERGY (Wh) |
| 1 | FULL | 23 | 52 | 52 | PARTIAL | 16 | 36 | 36 |
| 2 | FULL | 23 | 52 | 104 | PARTIAL | 16 | 36 | 72 |
| 3 | FULL | 23 | 52 | 156 | FULL | 23 | 52 | 124 |
| | | ... | | | | ... | | (-21%) |

FIG. 12

| | DEFROST CYCLE | CONVENTIONAL CASE | DEFROST HEATER+ PARTIAL DEFROSTING | PARTITIONED HEATER+ FULL DEFROSTING | PARTITIONED HEATER+ PARTIAL DEFROSTING |
|---|---|---|---|---|---|
| DEFROST ENERGY SAVING EFFECT | 2 | 104 | 88 (-15%) | 90 (-13%) | 81 (-22%) |
| | 3 | 154 | 124 (-21%) | 135 (-13%) | 117 (-25%) |
| | 4 | 208 | 160 (-23%) | 180 (-13%) | 153 (-26%) |
| | ... | | | | |

FIG. 13B

| | DEFROST COMPLETION TIME(Min) | TOP AREA TEMPERATURE (℃) | PERIODICITY | | | | | | |
|---|---|---|---|---|---|---|---|---|---|
| | | | 1 | 2 | 3 | 4 | 5 | 7 | 10 |
| DEFROST HEATER | 16 | 0.1 | 0% | 15% | 21% | 23% | 25% | 26% | 28% |
| | 17 | 1.1 | 0% | 13% | 18% | 20% | 21% | 23% | 24% |
| | 18 | 2.4 | 0% | 11% | 15% | 17% | 18% | 19% | 20% |
| | 19 | 5.3 | 0% | 9% | 12% | 13% | 14% | 15% | 16% |
| | 20 | 9.0 | 0% | 7% | 9% | 10% | 11% | 12% | 12% |
| | 21 | 11.8 | 0% | 5% | 6% | 7% | 7% | 8% | 8% |
| | 22 | 13.4 | 0% | 2% | 3% | 4% | 4% | 4% | 4% |
| | 23 | 14.8 | 0% | 0% | 0% | 0% | 0% | 0% | 0% |

| | DEFROST COMPLETION TIME(Min) | TOP AREA TEMPERATURE (℃) | PERIODICITY | | | | | | |
|---|---|---|---|---|---|---|---|---|---|
| | | | 1 | 2 | 3 | 4 | 5 | 7 | 10 |
| PARTITIONED HEATER | 16 | 0.1 | 13% | 22% | 25% | 26% | 27% | 28% | 29% |
| | 17 | 1.1 | 13% | 20% | 22% | 23% | 24% | 25% | 25% |
| | 18 | 2.4 | 13% | 18% | 19% | 20% | 20% | 21% | 21% |
| | 19 | 5.3 | 13% | 16% | 16% | 17% | 17% | 17% | 17% |
| | 20 | 9.0 | 13% | 13% | 13% | 13% | 13% | 13% | 13% |

REFRIGERATOR AND CONTROL METHOD THEREOF

CROSS-REFERENCE TO RELATED APPLICATION

This application is based on and claims priority under 35 U. S. C. § 119 to Korean Patent Application No. 10-2018-0149880 filed on Nov. 28, 2018, the disclosure of which is incorporated herein by reference in its entirety.

BACKGROUND

1. Field

The disclosure relates to a refrigerator and control method thereof for efficiently removing frost or ice formed on an evaporator.

2. Discussion of Related Art

Refrigerators are devices having a storeroom and a cold air supply for supplying cold air into the storeroom to keep food fresh.

The storeroom has an open front, which is closed by a door at ordinary times to maintain a temperature of the storeroom.

The cold air supply keeps the storeroom at a low temperature by pumping heat out of the storeroom by using a vapor compression refrigeration cycle.

The cold air supply includes an evaporator for generating cold air, a blower fan for guiding the cold air generated by the evaporator to be supplied into the storeroom, and a cold air duct for receiving and releasing the cold air guided by the blower fan into the storeroom.

The evaporator is connected to the storeroom, contacting humid air with relatively high temperature and absorbing the heat. In this process, supersaturated vapor contained in the humid air with relatively low temperature is condensed and frosted on the surface of the evaporator.

As the refrigerator continues to work, the frost is accumulated and thickened, making the flow rate of air passing the evaporator reduced. Furthermore, heat resistance on the surface of the evaporator increases and as a result, performance of the refrigeration cycle is degraded. Hence, for the refrigerator, there is a need for a defrost process to periodically remove the frost accumulated on the evaporator.

The refrigerator is generally defrosted by melting the frost through convectional and radiant heat transfer of heat generated by an electric heater arranged around the evaporator.

The electric heater is classified as a cord heater or a sheath heater depending on the material of the pipe.

Specifically, the cord heater includes an aluminum pipe and has the same arrangement feature as the tube of the evaporator. The cord heater is inexpensive but has a weak point in that it still leaves a large amount of frost after the defrost process. The sheath heater includes a nickel alloy pipe and is mainly placed under the evaporator. The sheath heater leaves less frost than the cord heater, but consumes a large amount of power as compared with the cord heater.

It is common for the recent refrigerator to use both the aforementioned cord heater and sheath heater to increase energy efficiency, however the combination also significantly increases the cost of operating the refrigerator.

The evaporator is divided into an area where much frost is formed and an area where little frost is formed, depending on contacts with humid air. In other words, the evaporator is frosted unevenly. Despite this, the conventional refrigerator operates the heater used in the defrost process regardless of the uneven formation of frost. This may cause an inefficient situation where some portions of the evaporator are overheated more than necessary.

SUMMARY

The disclosure provides a refrigerator and control method thereof, which divides an evaporator into areas in which frost or ice is formed in a defrost process using a sheath heater and efficiently performs defrosting for the areas, thereby reducing power consumption in the defrost process.

According to an aspect of the disclosure, a refrigerator includes a main body including a storeroom; an evaporator arranged in the back of the storeroom and configured to generate cold air; a defrost heater arranged under the evaporator into which air flows and configured to remove frost or ice formed on the evaporator; a temperature sensor arranged on the top of the evaporator and configured to measure temperature; and a controller configured to stop operation of the defrost heater in a first defrost cycle based on a first measurement measured by the temperature sensor and stop operation of the defrost heater in a second defrost cycle based on a second measurement, which is different from the first measurement.

The controller may determine a point in time to stop operation of the defrost heater in the first defrost cycle based on the first measurement, and change the point in time based on the second measurement in the second defrost cycle.

The controller may stop operation of the defrost heater in the second defrost cycle based on the second measurement, which is higher than the first measurement.

The controller may perform the first defrost cycle multiple times and control the defrost heater for the second defrost cycle with preset periodicity.

The controller may change the preset periodicity.

The controller may stop operation of the defrost heater in the second defrost cycle based on a third measurement, which is higher than the first measurement but lower than the second measurement.

The refrigerator may further include a cooling module including a compressor, a condenser, the evaporator, and an expander, and the controller may control the cooling module to be in a cooling cycle after stopping operation of the defrost heater in the defrost cycle, and initiate operation of the defrost heater in the second defrost cycle after completion of the cooling cycle.

The defrost heater may include a sheath heater including a pipe producing heat, and the pipe may be located under the evaporator.

The defrost heater may include a first pipe producing heat located under the evaporator and a second pipe banded from the first pipe, connected parallel to a heat exchange tube, and located in a center area of the evaporator.

The refrigerator may further include a second temperature sensor arranged in a center area of the evaporator, and the controller may stop operation of the defrost heater in the first defrost cycle based on a measurement measured by the temperature sensor, and stop operation of the defrost heater in the second defrost cycle based on a measurement measured by the second temperature sensor.

According to another aspect of the disclosure, a control method of a refrigerator includes operating a defrost heater in a first defrost cycle; stopping operation of the defrost heater in the first defrost cycle based on a first measurement measured by a temperature sensor; operating the defrost heater in a second defrost cycle; and stopping operation of the defrost heater in the second defrost cycle based on a second measurement measured by the temperature sensor.

The stopping of the operation of the defrost heater in the first defrost cycle may include determining a point in time to stop operation of the defrost heater in the first defrost cycle based on the first measurement.

The stopping of the operation of the defrost heater in the second defrost cycle may include changing the point in time determined in the first defrost cycle based on the second measurement.

The stopping of the operation of the defrost heater in the second defrost cycle may include stopping operation of the defrost heater in the second defrost cycle based on the second measurement, which is lower than the first measurement.

The control method may further include performing the second defrost cycle multiple times and performing the first defrost cycle with preset periodicity.

The performing of the second defrost cycle multiple times and the performing of the first defrost cycle with preset periodicity may include changing the preset periodicity.

The stopping of the operation of the defrost heater in the second defrost cycle may include stopping operation of the defrost heater in the second defrost cycle based on a third measurement, which is higher than the second measurement but lower than the first measurement.

The control method may further include stopping operation of the defrost heater in a third defrost cycle based on the second measurement.

The defrost heater may include a first pipe producing heat located under the evaporator and a second pipe banded from the first pipe, connected parallel to a heat exchange tube, and located in a center area of the evaporator.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts:

FIGS. 9 and 10 illustrate views for explaining advantages of a control method of a refrigerator, according to an embodiment of the disclosure;

FIG. 12 illustrates a table for explaining effects gained by performing a control method with a partitioned heater, according to an embodiment of the disclosure;

FIG. 13B illustrates a table for explaining effects gained by performing the control method, according to another embodiment of the disclosure;

DETAILED DESCRIPTION

Figure 1:
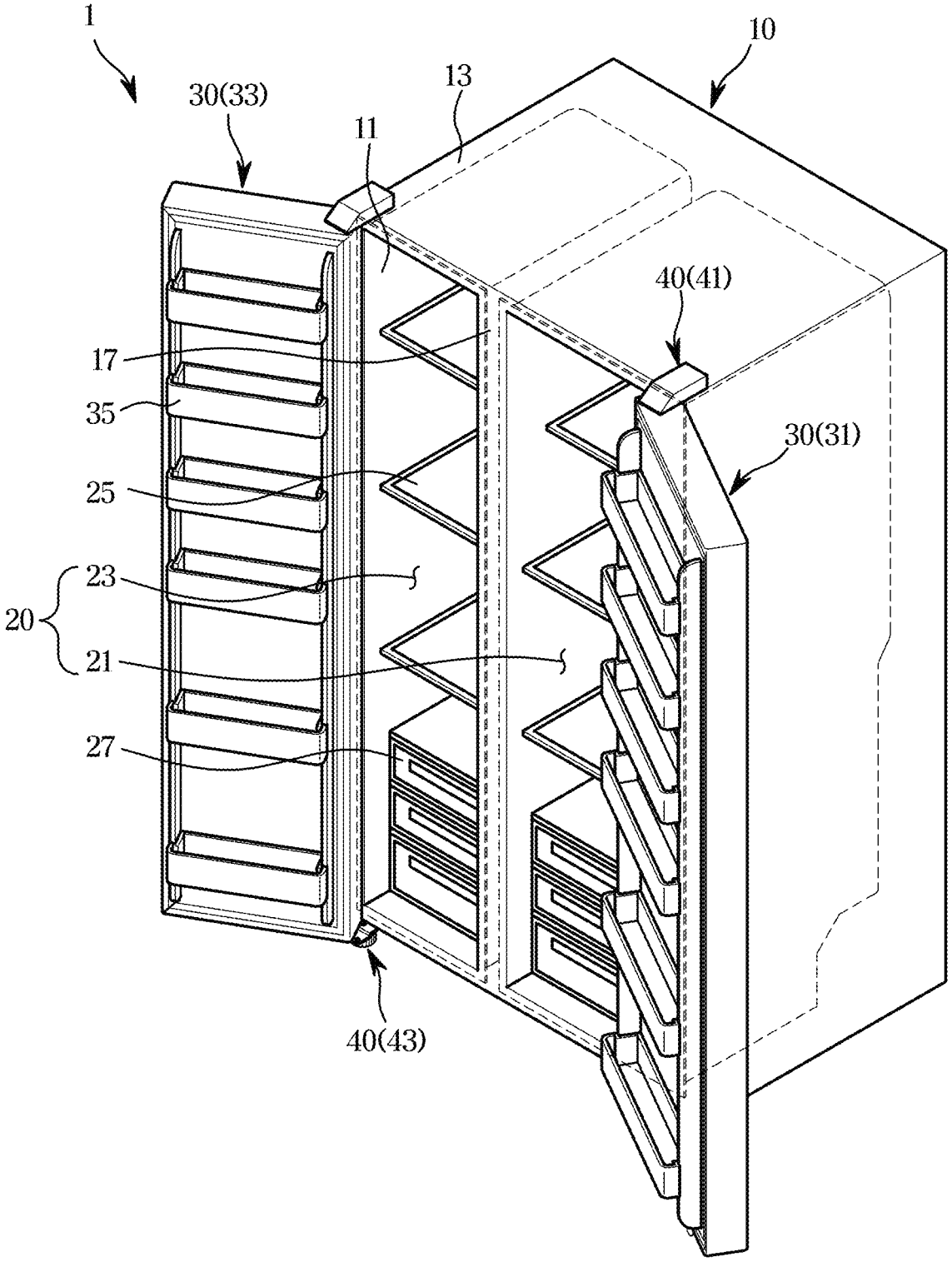
FIG. 1 illustrates a perspective view of a refrigerator, according to an embodiment of the disclosure.

FIGS. 1 through 16, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Like numerals refer to like elements throughout the specification. Not all elements of embodiments of the disclosure will be described, and description of what are commonly known in the art or what overlap each other in the embodiments will be omitted. The term 'unit, module, member, or block' may refer to what is implemented in software or hardware, and a plurality of units, modules, members, or blocks may be integrated in one component or the unit, module, member, or block may include a plurality of components, depending on the embodiment of the disclosure.

It will be further understood that the term "connect" or its derivatives refer both to direct and indirect connection, and the indirect connection includes a connection over a wireless communication network.

The term "include (or including)" or "comprise (or comprising)" is inclusive or open-ended and does not exclude additional, unrecited elements or method steps, unless stated otherwise.

Throughout the specification, when it is said that a member is located "on" another member, it implies not only that the member is located adjacent to the other member but also that a third member exists between the two members.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another element, component, region, layer or section.

It is to be understood that the singular forms "a," "an," and "the" include plural references unless the context clearly dictates otherwise.

Reference numerals used for method steps are just used for convenience of explanation, but not to limit an order of the steps. Thus, unless the context clearly dictates otherwise, the written order may be practiced otherwise.

The terms "upper", "lower", "top", and "bottom" as herein used are defined with respect to the drawings, but the terms may not restrict the shape and position of the respective components.

Refrigerators may be classified by types based on the form of storerooms and doors.

There may be top mounted freezer (TMF) typed refrigerators in which a storeroom is partitioned by a horizontal partition wall into upper and lower chambers with a freezer formed in the upper chamber and a fridge formed in the lower chamber, and bottom mounted freezer (BMF) typed refrigerators in which a fridge is formed in the upper chamber and a freezer is formed in the lower chamber.

Furthermore, there may be side by side (SBS) typed refrigerators in which a storeroom is partitioned by a vertical partition wall into left and right chambers with a freezer formed in one chamber and a fridge formed in the other chamber, and French door refrigerator (FDR) typed refrigerators in which a storeroom is partitioned by a horizontal partition wall into upper and lower chambers with a fridge formed in the upper chamber and a freezer formed in the lower chamber, the fridge in the upper chamber opened or closed by a pair of doors.

In embodiments of the disclosure, the SBS typed refrigerator will be described for convenience of explanation, but embodiments of the disclosure are not limited to the FDR typed refrigerators.

Figure 2:
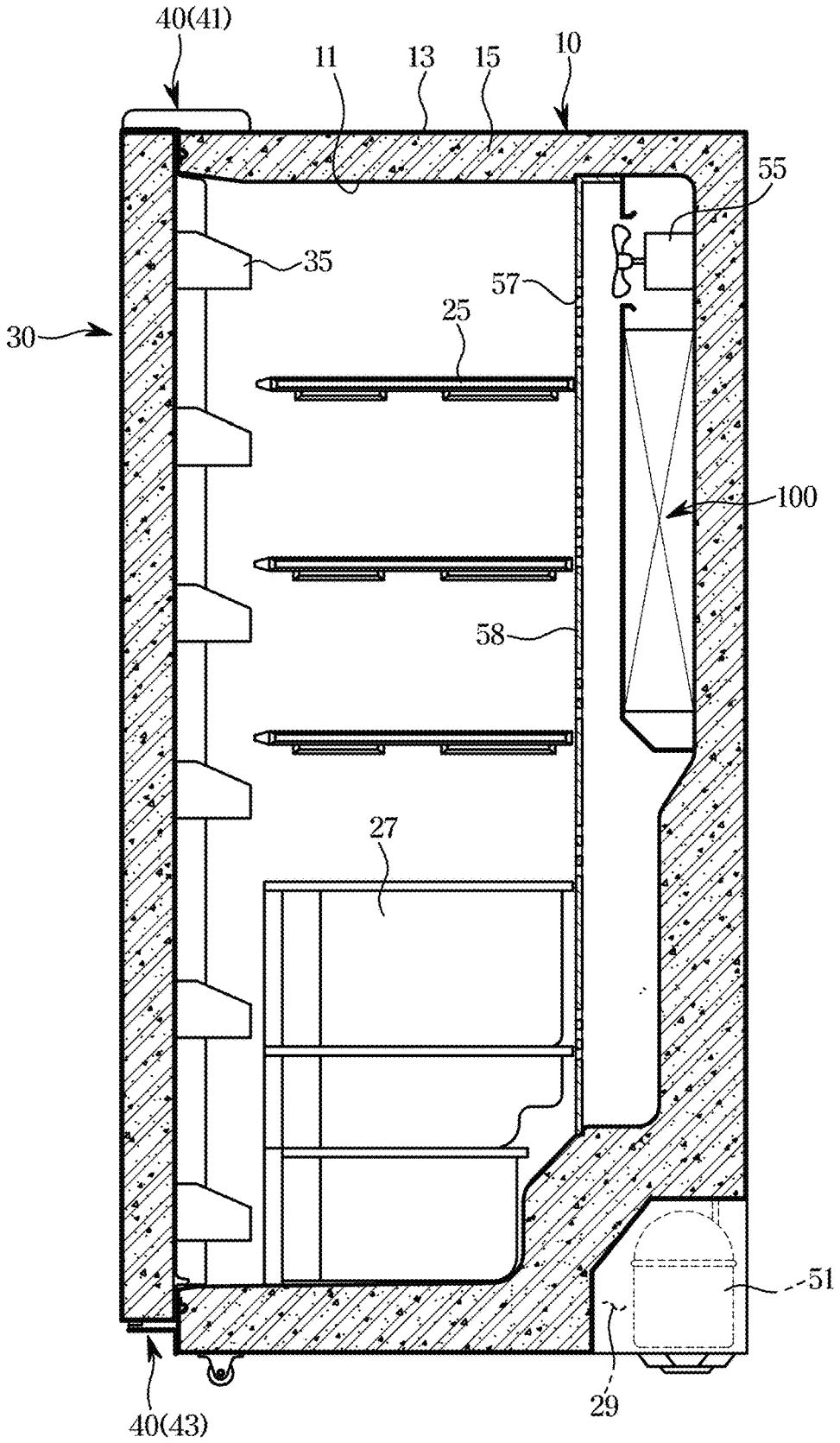
FIG. 2 illustrates a side cross-sectional view of a refrigerator, according to an embodiment of the disclosure.

FIG. 1 illustrates a perspective view of a refrigerator, according to an embodiment of the disclosure. FIG. 2 illustrates a side cross-sectional view of a refrigerator, according to an embodiment of the disclosure.

Referring to FIGS. 1 and 2, a refrigerator 1 includes a main body 10 that defines an exterior, a storeroom 20 arranged in the main body 10 with open front, doors 30 pivotally mounted on the main body 10 to open or close the open front of the storeroom 20, hinge modules 40 each having an upper hinge 41 and a lower hinge 43 for the door 30 to be pivotally mounted on the main body 10.

The main body 10 may include an inner case 11 that defines the storeroom 20 and an outer case 13 that defines the exterior, and an insulation 15 may be foamed between the inner case 11 and the outer case 13 for preventing cold air from leaking out.

The main body 10 may also include a partition wall 17 that divides the storeroom 20 into a fridge 21 and a freezer 23 in the left-and-right direction. For example, the fridge 21 may be arranged on the right of the main body 10 and the freezer 23 may be arranged on the left of the main body 10.

In the storeroom 20, there may be a plurality of shelves 25 and containers 27 to store food and groceries.

The storeroom 20 may be opened or closed by the doors 30 pivotally mounted on the main body 10, and specifically, the fridge 21 and freezer 23 are opened or closed by a fridge door 31 and a freezer door 33, respectively.

The fridge door 31 and the freezer door 33 may be pivotally coupled with the main body 10 by the hinge module 40 that includes the upper hinge 41 on the top of the main body 10 and the lower hinge 43 on the bottom of the main body 10.

On the rear sides of the fridge and freezer doors 31 and 33, a plurality of door guards 35 are arranged to contain food.

A machine room 29 where a compressor for compressing refrigerant and a condenser 52 (see FIG. 3) for condensing the compressed refrigerant are installed is provided on the lower side of a rear portion of the main body 10.

The compressor 51 and the condenser 52 provided in the machine room 29 may define a cooling module 50 together with an expander 53 and an evaporator 100. Cold air produced in the cooling module 50 is supplied into the storeroom 20. For example, a blower fan 55 and a cold air duct 58 having discharge holes 57 formed therethrough may have the cold air produced in the evaporator 100 discharged into the storeroom 20.

Figure 3:
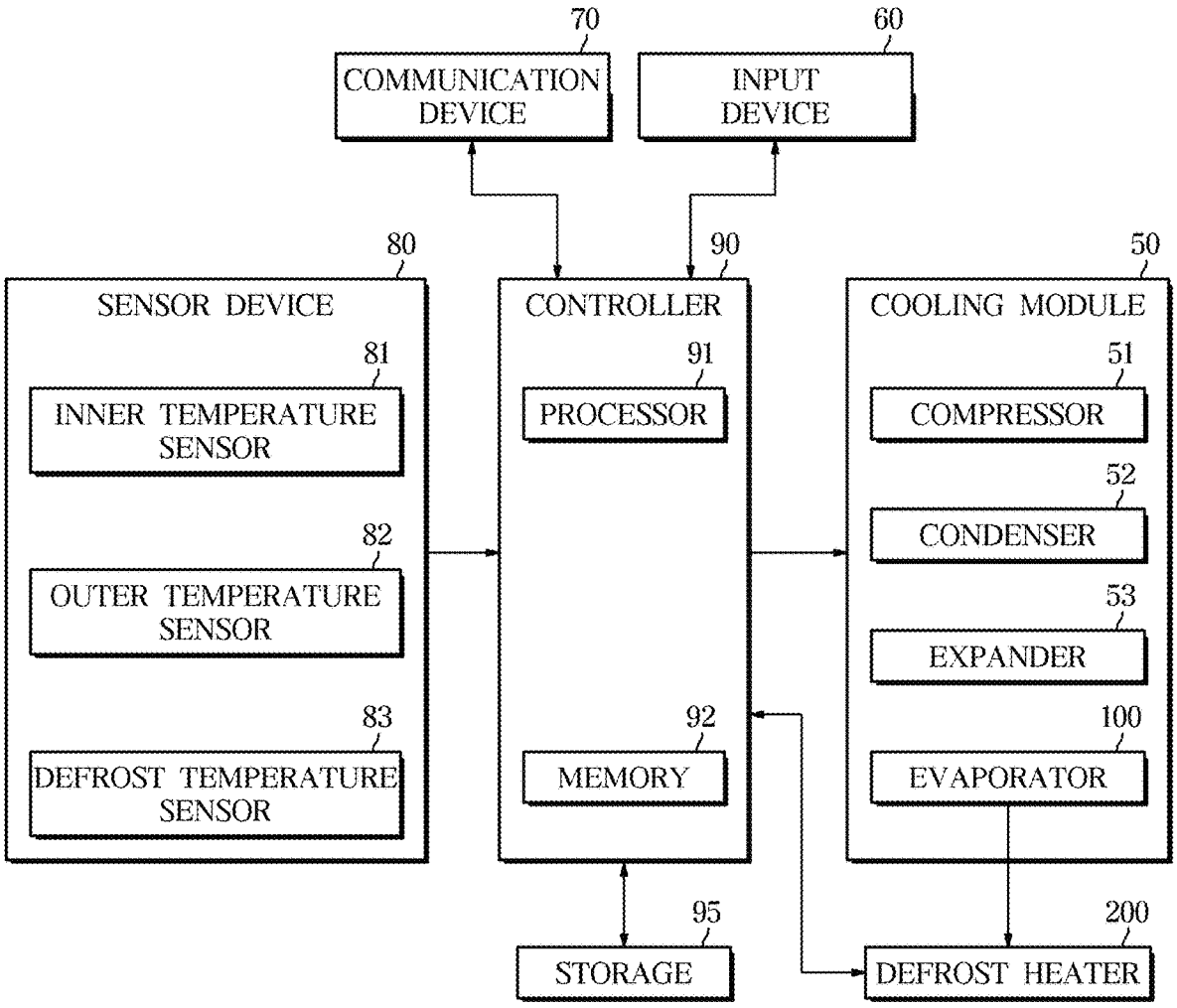
FIG. 3 illustrates a control block diagram of a refrigerator, according to an embodiment of the disclosure.

FIG. 3 is a control block diagram of a refrigerator, according to an embodiment of the disclosure.

Referring to FIG. 3, the refrigerator 1 may include the aforementioned cooling module 50, an input device 60 for receiving an input command from the user, a communication device 70 for performing communication with the outside, a sensor device 80 for performing various measurement on the inside or outside air temperature of the main body 10, opening or closing of the doors 30, etc., a storage 95 for storing results of the measurement performed by the sensor device 80 and various types of data, and a controller 90 for controlling the respective components of the refrigerator 1.

The cooling module 50 supplies cold air into the storeroom 20. Specifically, the cooling module 50 may make the temperature of the storeroom 20 maintained within a set range by using evaporation of the refrigerant.

The cooling module 50 may include the compressor 51 for compressing a gaseous refrigerant, the condenser 52 for changing the compressed gaseous refrigerant into a liquid state, the expander 53 for depressurizing the liquid refrigerant, and the evaporator 100 for changing the depressurized liquid refrigerant into a gaseous state. A cycle including a series of operations of the components of the cooling module 50 may be referred to as a cooling cycle.

The cooling module 50 may cool the air in the storeroom 20 using a phenomenon in which a liquid refrigerant absorbs thermal energy of surrounding air while the refrigerant is changing from liquid to gaseous state.

The evaporator 100 may include a tube 110 through which the refrigerant flows and a plurality of cooling fins 120 coupled to the outer circumferential surface of the tube 110 to facilitate heat exchange between the refrigerant flowing through the tube 110 and outside air. In the cooling cycle, the liquid refrigerant at a low temperature and low pressure is evaporated in the evaporator 100 while moving along the tube 110. The evaporator 100 absorbs heat required for evaporation of the refrigerant from the surrounding air. Accordingly, the air around the evaporator 100 may be cooled by being deprived of the heat by the evaporator 100.

As the air around the evaporator 100 is cooled down, thus lowering the relative humidity, dew condensation occurs in which water vapor contained in the air passing by the evaporator 100 is condensed. The water whose temperature drops below the freezing point is frozen, forming ice on the surface of the evaporator 100. The water vapor in the air may sublimate into frost by colliding with the low temperature surface of the evaporator 100.

A defrost heater 200 removes the ice or frost formed on the evaporator 100. In an embodiment of the disclosure, the defrost heater 200 may be a sheath heater. However, the defrost heater 200 is not limited to the sheath heater but may be any electric heater. The evaporator 100 and the defrost heater 200 will be described later in detail with reference to other accompanied drawings.

The input device 60 receives various input commands from the user.

The input device 60 may receive a target temperature at which the storeroom 20 is to keep its internal temperature, and an input command about an operating condition of the defrost heater 200.

The refrigerator 1 may variously change the point in time to stop operation of the defrost heater 200 in the defrost cycle for removing the ice or frost formed on the evaporator 100. The input device 60 may receive an input about a measurement of a defrost temperature sensor 83 from the user, which may be a baseline of the point in time to stop operation of the defrost heater 200.

The input device 60 may receive various other input commands. The input device 60 may include hardware devices such as many different buttons or switches, a pedal, a keyboard, a mouse, a track ball, various levers, a handle, a stick, or the like.

The input device 60 may also include a Graphical User Interface (GUI), i.e., a software device, such as a touch pad for the user input. The touch pad may be implemented with a Touch Screen Panel (TSP), thus forming a interlayer structure with a display device.

The display device may be used for the input device 60 when implemented with the TSP that forms the interlayer structure with the touch pad.

The communication device 70 may exchange data with a device external to the refrigerator 1.

For example, the communication device 70 may receive various control commands and measurements of the temperature sensor as a baseline for the point in time to stop operation of the defrost heater 200 from a server administrated by a manufacturer, and apply them for operation of a defrost cycle.

Besides, the communication device 70 may further perform various operations such as transmitting an image of the inside of the storeroom captured by a camera to user equipment.

The communication device 70 may include one or more components that enable communication with an external device, for example, at least one of a short-range communication module, a wired communication module, and a wireless communication module.

The short-range communication module may include various short range communication modules for transmitting or receiving signals within a short range over a wireless communication network, such as Bluetooth module, an infrared communication module, a radio frequency identification (RFID) communication module, a wireless local access network (WLAN) communication module, a near field communication (NFC) module, a Zigbee communication module, etc.

The wired communication module may include not only one of various wired communication modules, such as a local area network (LAN) module, a wide area network (WAN) module, or a value added network (VAN) module, but also one of various cable communication modules, such as a universal serial bus (USB), a high definition multimedia interface (HDMI), a digital visual interface (DVI), recommended standard 232 (RS-232), a power cable, or a plain old telephone service (POTS).

The wireless communication module may include a wireless fidelity (WiFi) module, a wireless broadband (Wibro) module, and/or any wireless communication device for supporting various wireless communication schemes, such as a global system for mobile communication (GSM) module, a code division multiple access (CDMA) module, a wideband code division multiple access (WCDMA) module, a universal mobile telecommunications system (UMTS), a time division multiple access (TDMA) module, a long term evolution (LTE) module, etc.

The sensor device 80 may include an inner temperature sensor 81 for detecting inside temperature of the storeroom 20, and an outer temperature sensor 82 for detecting various temperatures required for the cooling cycle and the defrost cycle of the refrigerator 1.

The inner temperature sensor 81 may detect respective temperature of spaces defined by dividing the storeroom 20 by the partition wall 17 and shelves 25, and output an electric signal corresponding to the detected temperature to the controller 90. Each of the inner temperature sensors 81 may include a thermistor temperature sensor that uses semiconductor resistance changed by the temperature.

The outer temperature sensor 82 may detect temperature around where the refrigerator 1 is installed, i.e., an ambient temperature. The outer temperature sensor 82 may also detect the temperature required for operation of a cooling cycle, e.g., the temperature for identifying operation of each component of the cooling module 50. The outer temperature sensor 82 may output the detected temperature to the controller 90.

The outer temperature sensor 82 may be implemented as a contact-type temperature sensor or a non-contact-type temperature sensor depending on the detection method. Specifically, the outer temperature sensor 82 may be implemented not only as the thermistor temperature sensor as described above in connection with the inner temperature sensor 81 but also at least one of a resistance temperature detector (RTD) that uses metal resistance changed by temperature, a thermocouple temperature sensor that uses electromotive force produced across a junction between two types of metal wires having different substances, and an integrated circuit (IC) temperature sensor that uses current-voltage characteristics of a P-N junction or a voltage across a transistor changed by temperature. The outer temperature sensor 82 may, however, include other various temperature sensors.

As an example of the outer temperature sensor 82, the sensor device 80 may include the defrost temperature sensor 83 arranged on the evaporator 100 for detecting air temperature changing according to the operation of the defrost heater 200. The defrost temperature sensor 83 will be described later in detail with reference to other accompanied drawings.

The sensor device 80 may further include other various sensors than the temperature sensor, including a sensor for detecting whether the door 30 is opened or closed, an image sensor for capturing an image of the inside of the storeroom 20 and converting the image into an electric signal, etc.

The storage 95 may store a program and/or data, and collect the program and/or data through a contact terminal capable of contacting an external storage medium.

The program may include a plurality of instructions combined to perform a particular function, and the data may be processed according to the plurality of instructions included in the program. Furthermore, the program and/or data may include a system program and/or system data directly related to operation of the refrigerator 1, and an application program and/or application data for providing convenience and entertainment for the user.

The storage 95 may be implemented with at least one of a non-volatile memory device, such as cache, read only memory (ROM), programmable ROM (PROM), erasable programmable ROM (EPROM), electrically erasable programmable ROM (EEPROM), a volatile memory device, such as random access memory (RAM), or a storage medium, such as hard disk drive (HDD) or compact disk (CD) ROM, without being limited thereto.

The storage 95 may store and output a program and/or data to the controller 90. The storage 95 may store a program and/or data that may be executed by the controller 90 to perform an operation as will be described below.

The controller 90 may include a memory 92 for loading and memorizing the program and/or data stored in the storage 95, and a processor 91 for performing operation of the refrigerator 1 including operations of the cooling cycle and the defrost cycle according to the program and/or data stored in the memory 92. In addition to the hardware such as the memory 92 and the processor 91, the controller 90 may further include software, such as the program and/or data stored in the memory 92 and processed by the processor 91.

The memory 92 may store programs and/or data for controlling components of the refrigerator 1, and store temporary data produced while the components of the refrigerator 1 is controlled.

For example, the memory 92 may store a program and/or data for controlling operation of the defrost heater 200 based on a detection result of the defrost temperature sensor 83, and may temporarily store the detection result of the defrost temperature sensor 83.

Furthermore, the memory 92 may temporarily store an input command about a point in time to stop operation of the defrost heater 200 received through the input device 60. In this case, the processor 91 may collect data stored in the memory 92 and then apply the data for operation of the subsequent defrost cycle.

The memory 92 may include a non-volatile memory, such as a ROM, a flash memory, and/or the like, which may store data for a long period, and a volatile memory, such as a static random access memory (SRAM), a dynamic RAM (DRAM), or the like, which may temporarily store data.

The processor 91 may create a control signal for the components of the cooling module 50 that operate in the cooling cycle based on the program and/or data stored in the memory 92 and a control signal for the defrost heater 200 that operates in the defrost cycle.

Specifically, the processor 91 determines a condition to initiate operation of a defrost cycle after operation of a cooling cycle. There are various conditions to initiate operation of a defrost cycle depending on the detection result of the outside air and the inside temperature of the storeroom 20 detected by the inner temperature sensor 81.

Under the condition to initiate operation of a defrost cycle, the processor 91 creates a control signal for the defrost heater 200 to operate the defrost heater 200. In the defrost cycle in which the defrost heater 200 is operated, the processor 91 continuously receives measurements of the detected temperature from the defrost temperature sensor 83. When the received temperature measurement is met with a preset temperature measurement, operation of the defrost cycle is stopped. Furthermore, the processor 91 may variously change a reference measurement to stop operation of the defrost heater 200 for each defrost cycle, to reduce unnecessary consumption of power produced for the defrost operation. This will be described later in more detail with reference to accompanying drawings.

The processor 91 may include a core for performing logic operation and arithmetic operation, and a register for storing the data resulting from the operation.

At least one component may be added to or deleted from what is shown in FIG. 3 to correspond to the performance of the refrigerator 1. Furthermore, mutual positions of the components may be changed to correspond to the performance or structure of the system. The components of the refrigerator 1 shown in FIG. 3 may be implemented in software, or hardware such as Field Programmable Gate Arrays (FPGAs) and Application Specific Integrated Circuits (ASICs).

Figure 4A:
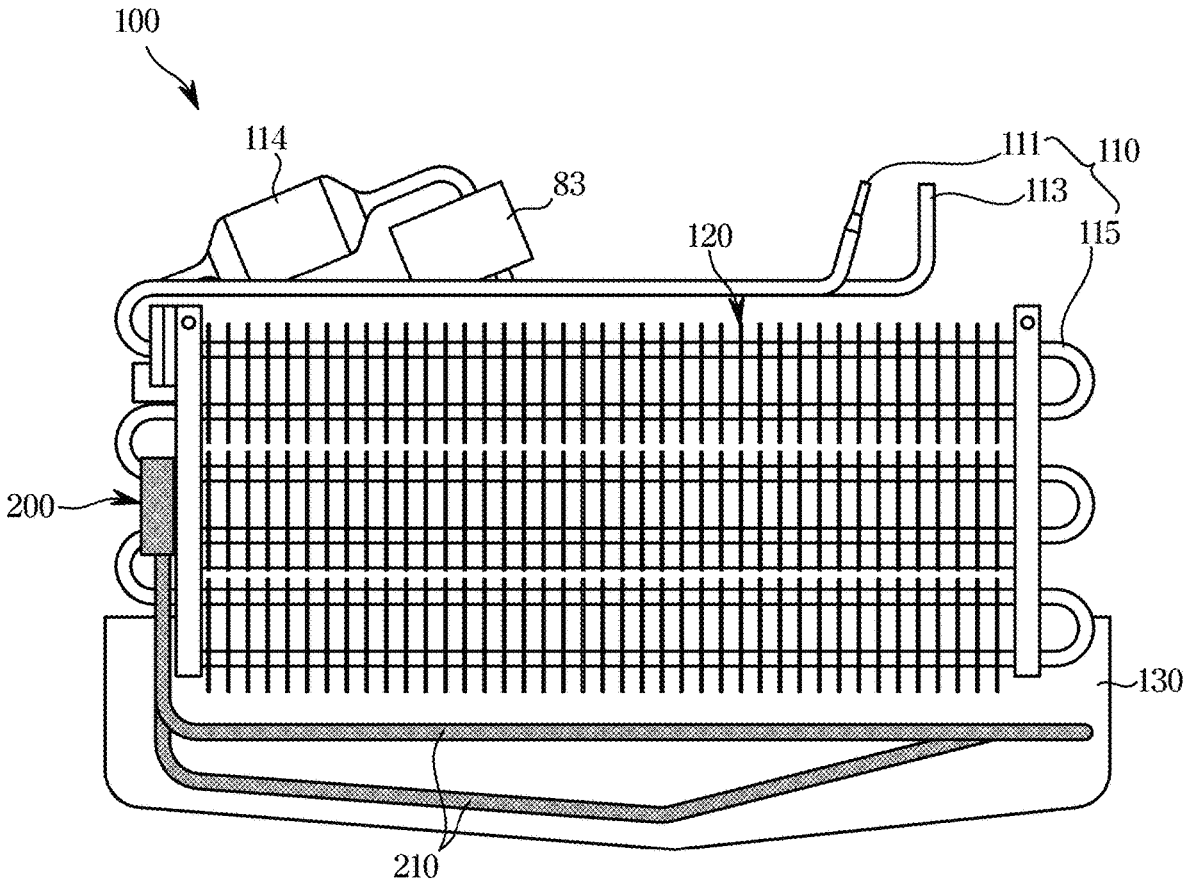
FIGS. 4A and 4B illustrate views for explaining configurations of an evaporator and a defrost heater, according to an embodiment of the disclosure.
Figure 4B:
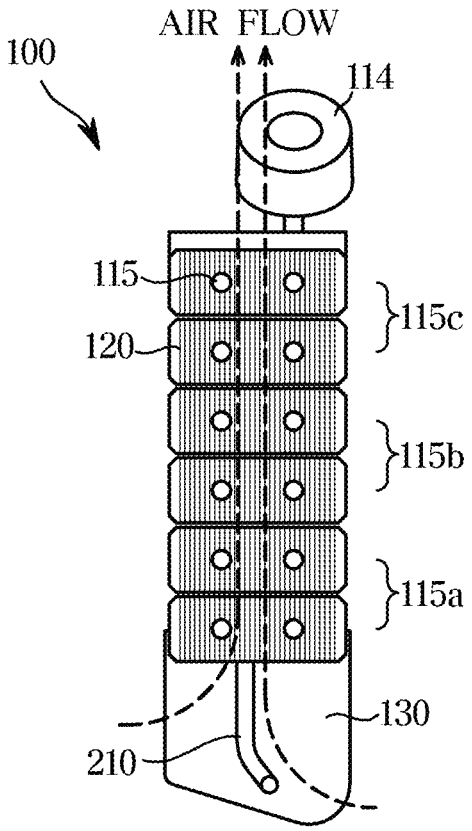

FIGS. 4A and 4B illustrate views for explaining configurations of an evaporator and a defrost heater, according to an embodiment of the disclosure. Specifically, FIG. 4A shows a structure of an evaporator viewed from one side, and FIG. 4B shows the structure of the evaporator viewed from another side.

Referring to FIGS. 4A and 4B, the evaporator 100 includes the tube 110 through which the refrigerant flows, and the plurality of fins 120 for facilitating heat exchange between the refrigerant flowing through the tube 110 and outside air.

The tube 110 may be divided into an incoming tube 111 to bring in the refrigerant, an outgoing tube 113 to release the refrigerant brought into the tube 110 and having exchanged heat with air, and a heat exchange tube 115 coupled with the plurality of fins 120.

The tube 110 may have an elongated form so as to widen the heat exchange area between the refrigerant flowing in the tube 110 and the outside air. Hence, the heat exchange tube 115 may have a winding shape rather than a straight shape, which is bent several times as shown in FIG. 4A. This may overcome space limitations to the tube 110, and efficiently allow the tube 110 to have a widened heat exchange area in a limited space.

The heat exchange tube 115 may be divided into a bottom area 115*a*, a center area 115*b*, and a top area 115*c* with respect to a pipe 210 of the defrost heater 200.

Referring to FIG. 4B, humid air collected from the storeroom 20 flows into the bottom area 115*a* of the evaporator 100, passes the heat exchange tube 115, and is released into the top area 115*c*. The bottom area 115*a* that first comes into contact with the collected humid air has more frost or ice accumulated therein than in the other areas.

The defrost heater 200 includes heat wires that produce heat when the defrost heater 200 is powered on. For example, the defrost heater 200 may be a sheath heater having the banding pipe 210 with a coiled heating wire inserted thereto. The pipe 210 of the sheath heater causes heat transfer through convection and radiation, which melts and removes the frost accumulated on the tube 110 and the plurality of fins 120.

A defrost drain pan 130 is provided in the back of the evaporator 100 and the defrost heater 200 for collecting defrost drain water of the frost or ice melting and falling by gravity. The defrost drain pan 130 may be punctured to release the defrost drain water.

An accumulator 114 may be provided at the outgoing tube 113 to evaporate the refrigerant released out of the tube 110. The defrost temperature sensor 83 may be arranged between the accumulator 114 and the outgoing tube 113.

The defrost temperature sensor 83 converts a measured temperature into an electric signal and sends the electric signal to the controller 90. As described above in connection with FIG. 3, the measurement sent from the defrost temperature sensor 83 is used for a reference point to stop operation of the defrost heater 200 in a defrost cycle.

The defrost temperature sensor 83 may be placed differently from what is shown in FIG. 4A. Specifically, the defrost temperature sensor 83 may be provided in the plural. For example, a first defrost temperature sensor may be arranged between the accumulator 114 and the outgoing tube 113 and a second defrost temperature sensor may be arranged in any location including the center area 115*b* of the evaporator 100.

Figure 5A:
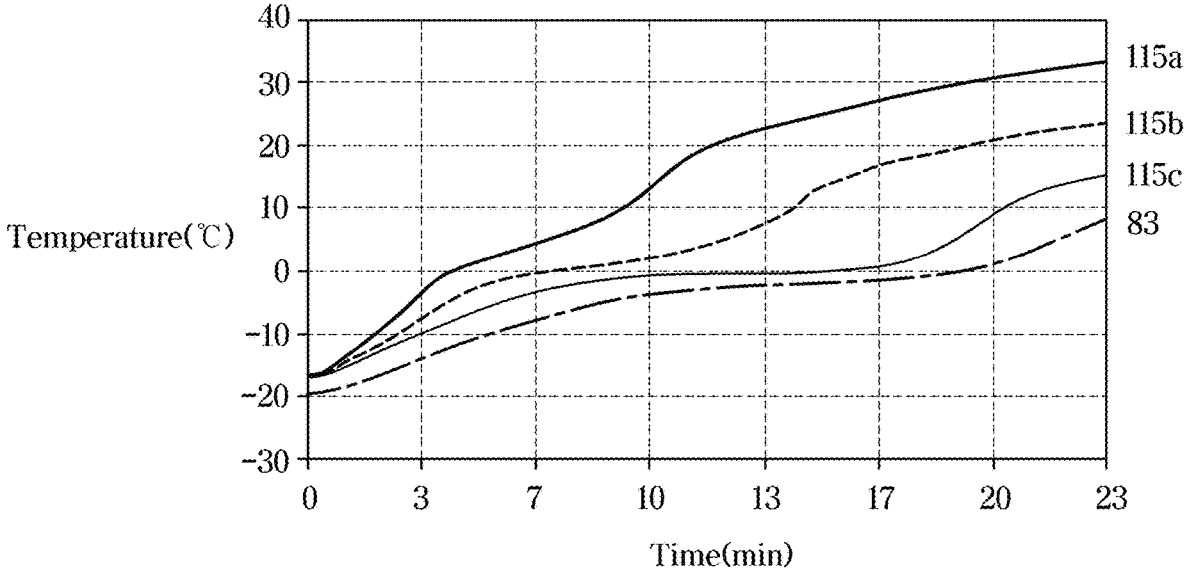
FIGS. 5A and 5B illustrate views for explaining problems with operation of a normal defrost cycle.
Figure 5B:
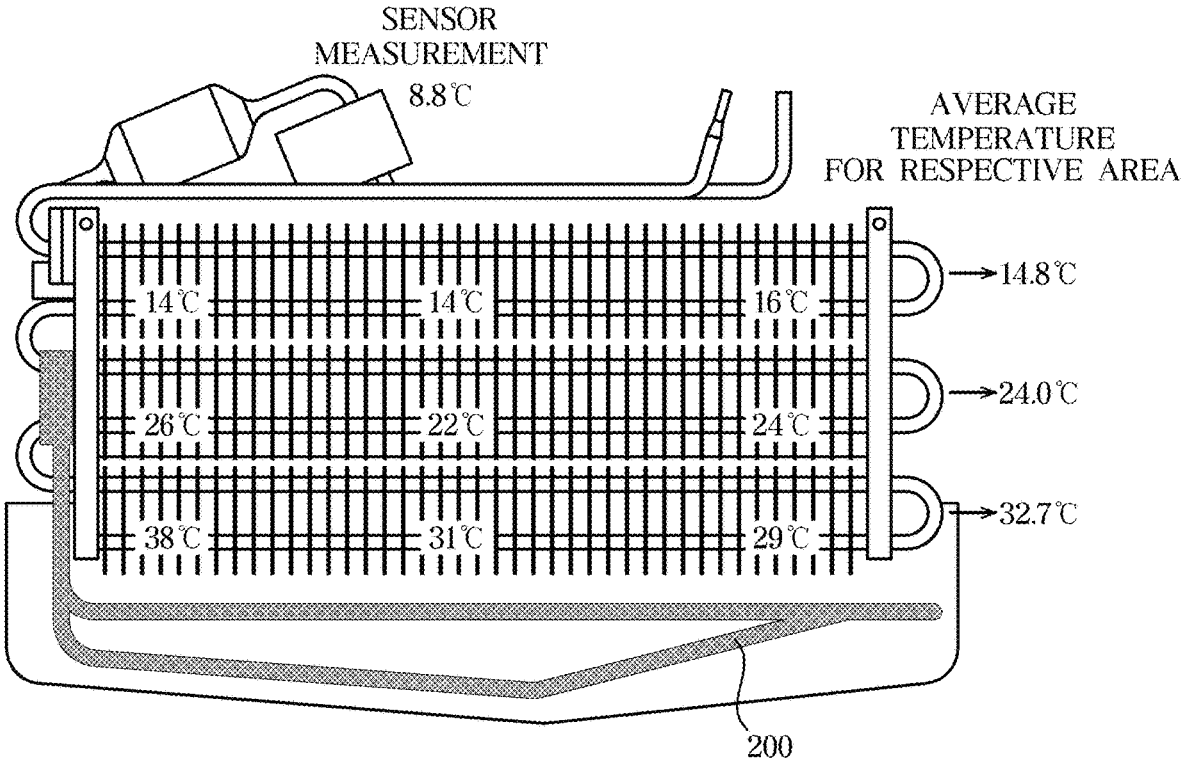

FIGS. 5A and 5B illustrate views for explaining problems with operation of a normal defrost cycle. Specifically, FIG. 5A shows the temperature distribution by time for respective areas in a defrost cycle, and FIG. 5B shows the temperature distribution of an evaporator at the completion time of the defrost cycle.

A conventional normal defrost cycle may also be applied in the evaporator 100 and the defrost heater 200 shown in FIG. 4A. As for the conventional defrost cycle, however, stopping of the operation of the defrost heater 200 located in the bottom area 115*a* is simply determined based on a measurement result of the defrost temperature sensor 83 located in the top area 115*c*.

Referring to FIG. 5A, in a defrost cycle that proceeds for 23 minutes, the respective areas 115*a*, 115*b*, and 115*c* of the evaporator 100 are heated at the same temperature from a starting point of the defrost cycle, 0 minute. As time passes, the temperature of the bottom area 115*a* where the pipe 210 of the defrost heater 200 is located rises rapidly and the temperature of the top area 115*c* rises at a relatively slow rate.

As for the conventional normal defrost cycle, operation of the defrost heater 200 is stopped when the defrost temperature sensor 83 detects a temperature corresponding to a preset temperature, e.g., 8.8 degrees. In other words, a defrost completion time applies equally to each defrost cycle.

Referring to FIG. 5B, at the defrost completion time, 23 minutes, the average temperature of the evaporator 100 is measured to be 32.7, 24.0, and 14.8 degrees in the bottom area 115*a*, center area 115*b*, and top area 115*c*, respectively. That is, the respective areas of the evaporator 100 have different temperature rise rates. However, in the conventional defrost cycle that keeps operating the defrost heater 200 to increase even the temperature of the top area 115*c* that has relatively less frost, the temperature of the bottom area 115*a* overly rises till the defrost completion time. This defrost energy inefficiency wastes power and causes another waste of energy for the subsequent cooling cycle to be performed after the defrost cycle.

Figure 6:
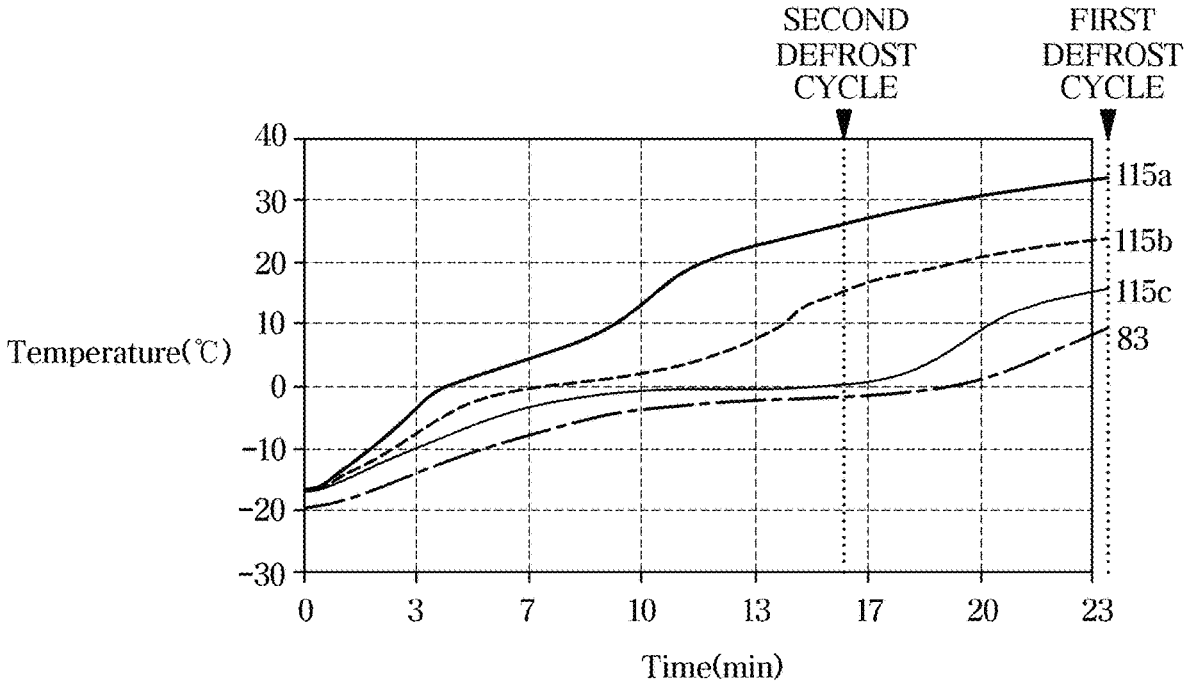
FIG. 6 illustrates a graph for explaining a control method of a refrigerator, according to an embodiment of the disclosure.

FIG. 6 is a graph for explaining a control method of a refrigerator, according to an embodiment of the disclosure.

Referring to FIG. 6, unlike the control method for the conventional normal defrost cycle, the refrigerator 1 according to an embodiment of the disclosure changes the defrost completion time for each defrost cycle and performs defrosting.

Specifically, the refrigerator 1 may operate the defrost heater 200 for 23 minutes in a defrost cycle (hereinafter called a first defrost cycle) performed after completion of the first cooling cycle. After completion of the first defrost cycle, the refrigerator 1 performs a cooling cycle and operates the defrost heater 200 again (hereinafter, called a second defrost cycle).

The refrigerator 1 may move up the defrost completion time of the second defrost cycle to 15 to 16 minutes and operate the defrost heater 200. Specifically, to move up the defrost completion time of the second defrost cycle to be earlier than in the first defrost cycle, the refrigerator 1 stops operation of the defrost heater 200 even when a measurement of the defrost temperature sensor 83 is below 0 degree.

In this way, the refrigerator 1 performs defrosting operations of the first and second defrost cycles differently, thereby reducing consumption of energy required for defrosting while gaining the same defrosting effect as in the conventional occasion.

The temperature measurement value and the defrost completion time are not limited to what are illustrated in FIG. 6, but may be changed by the user's input.

Figure 7:
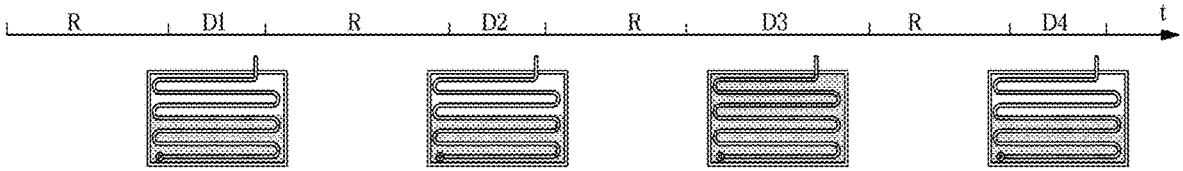
FIGS. 7 and 8 illustrate views for explaining examples of defrost cycles with different periodicity.
Figure 8:
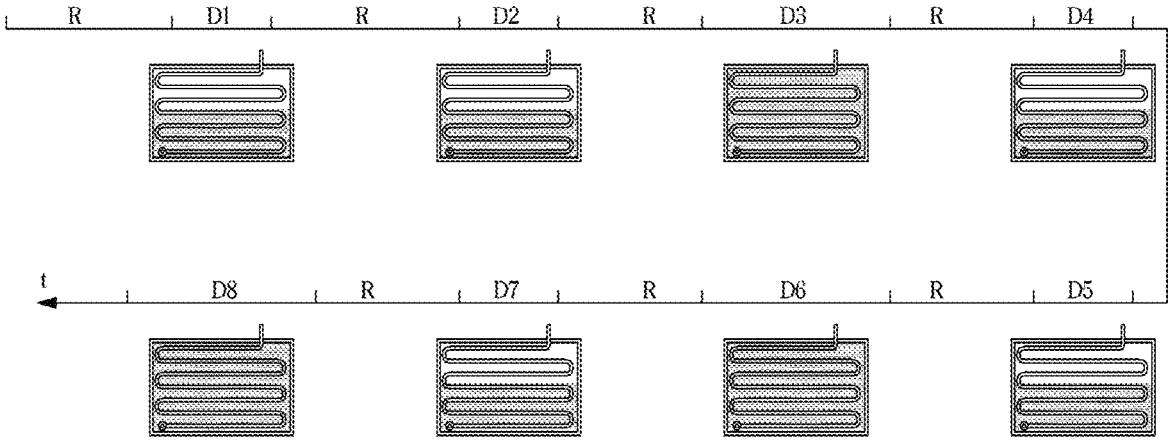

FIGS. 7 and 8 illustrate views for explaining examples of defrost cycles with different periodicity.

Referring first to FIG. 7, the refrigerator 1 according to an embodiment of the disclosure may perform a control method that moves up the defrost completion time for the first defrost cycle D1 after completion of a cooling cycle R (partial defrosting). In the partial defrosting, the refrigerator 1 shortens operation period of the defrost heater 200 and controls the temperature to rise as far as up to the center area 115*b* of the evaporator 100.

When the first defrost cycle D1 is completed, the refrigerator 1 controls the cooling module 50 to be back in the cooling cycle R.

When the cooling cycle R is completed, the refrigerator 1 sets a measurement value of the defrost temperature sensor 83 to stop operation of the defrost heater 200 for the second defrost cycle D2 to be equal to the measurement value for the first defrost cycle D1. In other words, even in the second defrost cycle D2, the refrigerator 1 performs the partial defrosting so that defrosting is done up to the center area 115*b* of the evaporator 100.

When the second defrost cycle D2 is completed, the refrigerator 1 controls the cooling module 50 to be back in the cooling cycle R.

When the cooling cycle R is completed, the refrigerator 1 sets the measurement value of the defrost temperature sensor 83 for a third defrost cycle D3 to be higher than the measurement value for the first defrost cycle D1. For example, for the third defrost cycle D3, the refrigerator 1 operates the defrost heater 200 so that defrosting is done up to the top area 115*c* of the evaporator 100.

When the third defrost cycle D3 is completed, the refrigerator 1 controls the cooling module 50 to be back in the cooling cycle R.

When the cooling cycle R is completed, the refrigerator 1 performs partial defrosting. Specifically, the refrigerator 1 may set the periodicity of a defrost cycle that performs full defrosting to be 3.

Accordingly, the refrigerator 1 may perform partial defrosting and perform full defrosting every N defrost cycles.

Referring to FIG. 8, the refrigerator 1 may perform partial defrosting in the first and second defrost cycles D1 and D2 and full defrosting in the third defrost cycle D3. Furthermore, the refrigerator 1 may perform partial defrosting in fourth and fifth defrost cycles D4 and D5 and full defrosting in a sixth defrost cycle D6, according to the periodicity set to 3.

The refrigerator 1 may, however, change the periodicity to perform full defrosting in the eighth defrost cycle D8 after performing partial defrosting in the seventh defrost cycle D7.

For example, the refrigerator 1 may detect a sudden rise in temperature of outside air brought in during operation. Furthermore, there may be an occasion when the user puts hot food into the storeroom 20, causing the refrigerator 1 to overly operate the cooling module 50. In this case, a lot of frost or ice may be formed on the evaporator 100.

The refrigerator 1 may dynamically change the periodicity of the defrost cycle depending on the dynamically changing condition.

Figure 10:
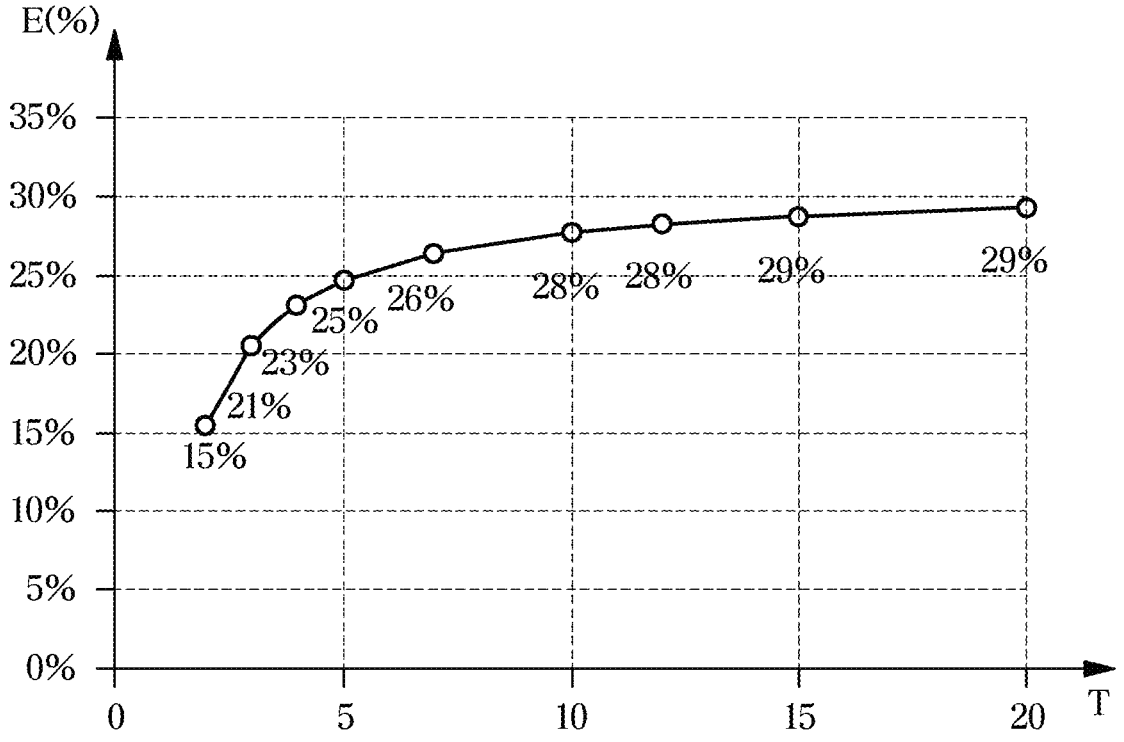

FIGS. 9 and 10 illustrate views for explaining advantages of a control method of a refrigerator, according to an embodiment of the disclosure. Specifically, FIG. 9 illustrates a table for explaining energy saving effects gained by performing full defrosting and partial defrosting with different periodicity, and FIG. 10 illustrates a graph for explaining reduction rates of energy saved with the different periodicity.

In (a) of FIG. 9, the periodicity of full defrosting is set to 2.

The conventional refrigerator always performs full defrosting in each defrost cycle. In this case, energy accumulated for the first to second defrost cycles is e.g., 104 WH.

Unlike this, the refrigerator 1 according to an embodiment of the disclosure performs partial defrosting in the first defrost cycle and full defrosting in the second defrost cycle. In this case, accumulated energy consumed by the refrigerator 1 is about 88 WH, which is saved by about 15% as compared with the conventional case.

In (b) of FIG. 9, the periodicity of full defrosting is set to 3. It means that the refrigerator 1 according to the embodiment of the disclosure performs partial defrosting in the first and second defrost cycles and full defrosting in the third defrost cycle.

The conventional refrigerator performing full defrosting until in the third defrost cycle has accumulated energy consumption of about 156 WH. Unlike this, accumulated energy consumed by the refrigerator 1 in the embodiment of the disclosure is about 124 WH, which is saved by about 21% as compared with the conventional case.

In the graph of FIG. 10, the X axis represents periodicity T of full defrosting, and Y axis represents reduction rates of accumulated energy E.

The number 5 on the X axis of the graph indicates that the refrigerator 1 has performed partial defrosting until in the fourth defrost cycle and full defrosting in the fifth defrost cycle. In this case, the reduction rate on the Y axis of the graph is 25%, meaning that energy is saved by 25% as compared with the conventional case.

From the slope of the graph, it is understood that control to have long periodicity of full defrosting does not always increase the energy saving rate. For example, even when the periodicity of full defrosting is set to 20, the energy reduction rate relative to the conventional case increases by just 4% as compared with the control method that sets the periodicity to 5.

Furthermore, when the periodicity of full defrosting is set to be too long, the frost on the evaporator 100 might not be completely removed. Accordingly, in the embodiment of the disclosure, the refrigerator 1 may control the periodicity of full defrosting within a set range to increase energy consumption efficiency while gaining the same defrosting effect as in the conventional case.

Figure 11A:
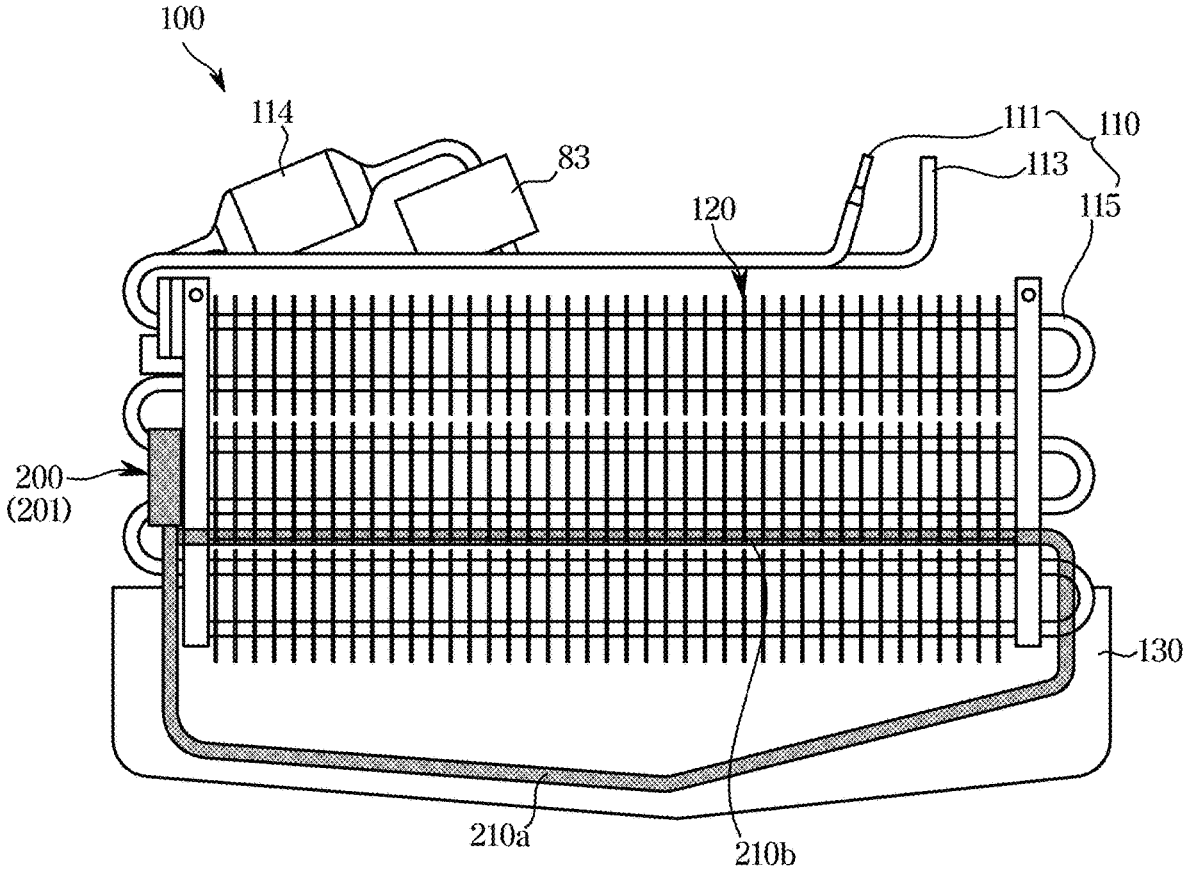
FIG. 11A illustrates a view for explaining a structure of a defrost heater, according to another embodiment of the disclosure.
Figure 11B:
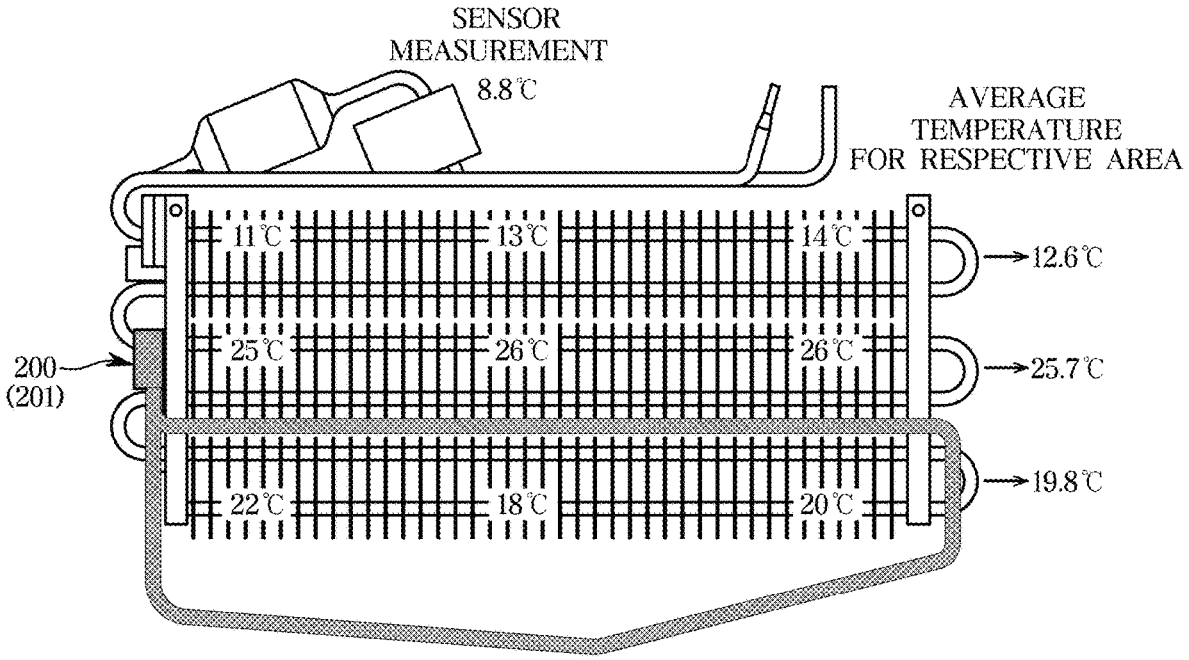
FIG. 11B illustrates a view for explaining temperature distributions in respective areas at a completion time of defrosting.
Figure 11C:
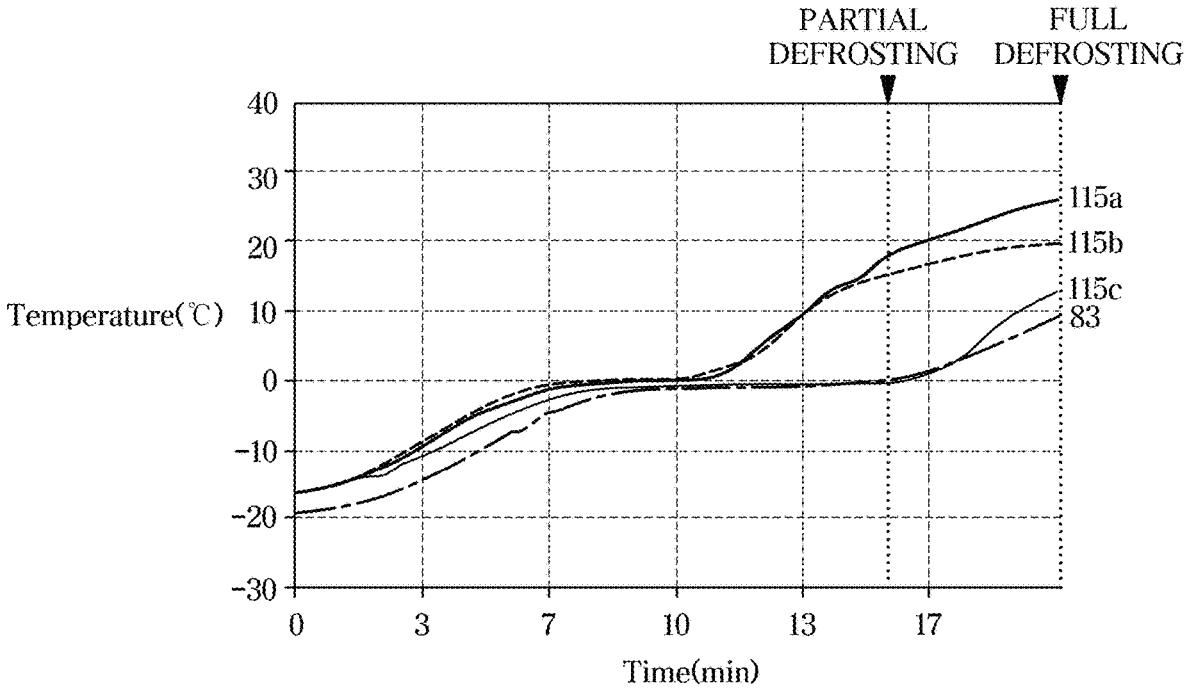
FIG. 11C illustrates a graph for explaining a method of controlling a defrost heater, according to an embodiment of the disclosure.

FIG. 11A illustrates a view for explaining a structure of a defrost heater, according to another embodiment of the disclosure, FIG. 11B illustrates a view for explaining temperature distributions in respective areas at a completion time of defrosting, and FIG. 11C illustrates a graph for explaining a method of controlling a defrost heater, according to an embodiment of the disclosure.

Referring to FIG. 11A, in an embodiment of the disclosure, the defrost heater 200 may have the pipe 210 divided into two: a first pipe 210*a* located in the bottom area 115*a* of the evaporator 100 and a second pipe 210*b* located in the center area 115*b* of the evaporator 100. For example, the second pipe 210*b* may be banded from the first pipe 210*a* and connected parallel to the heat exchange tube 115.

In this embodiment of the disclosure, the defrost heater 200 may also be provided as a sheath heater, which may remove frost or ice formed on the evaporator 100 through thermal convection and radiation. Accordingly, the first and second pipes 210*a* and 210*b* may also include heat wires therein. To distinguish from what is shown in FIG. 4A, the defrost heater 200 according to this embodiment of the disclosure will now be referred to as a partitioned heater 201.

When full defrosting is performed with the partitioned heater 201, temperature distributions may be seen as in FIG. 11B. Specifically, with the partitioned heater 201, when the defrost temperature sensor 83 is set to 8.8 degrees, average temperatures in the bottom, center, and areas 115*a*, 115*b*, and 115*c* may be measured to be about 19.8, 25.7, and 12.6 degrees, respectively.

Referring to FIG. 11C, the refrigerator 1 may operate the partitioned heater 201 for one defrost cycle. The partitioned heater 201 has the second pipe 210*b* located in the center area 115*b*, so an area where the defrost temperature sensor 83 is located, which includes the top area 115*c*, rises in temperature in a shorter period. Furthermore, when the defrost completion time is set to when a measurement of the defrost temperature sensor 83 is about 8.8 degrees, the defrost completion time of a defrost cycle in the refrigerator 1 with the partitioned heater 201 may be shortened to 20 minutes or less.

Even the refrigerator 1 with the partitioned heater 201 may perform partial defrosting. When the partitioned heater 201 performs partial defrosting, the defrost cycle with the partitioned heater 201 may have an earlier defrost completion time than in the refrigerator 1 with the defrost heater 200. Furthermore, even in full defrosting, the refrigerator 1 with the partitioned heater 201 may save more defrost energy than in the refrigerator 1 with the defrost heater 200, so the refrigerator 1 with the partitioned heater 201 may have an increased defrost energy saving effect.

FIG. 12 illustrates a table for explaining effects gained by performing a control method with a partitioned heater, according to an embodiment of the disclosure.

Referring to FIG. 12, a conventional normal refrigerator has the defrost heater 200 located in the bottom area 115*a* of the evaporator 100 and performs full defrosting. In this case, accumulated energy consumption until in the fourth cycle is measured to be about 208 WH.

On the other hand, the refrigerator 1 according to an embodiment of the disclosure may have the defrost heater 200 located in the bottom area 115*a* of the evaporator 100 and perform partial defrosting. In this case, accumulated energy consumption after full defrosting is performed every four cycles is about 160 WH. As compared with the conventional case, there is 23% of energy saving effect.

In another example, the refrigerator 1 may include the partitioned heater 201 and perform full defrosting. In this case, accumulated energy consumption until in the fourth cycle is about 180 WH, which is 10% less than the energy saving effect in the previous example. In yet another example, when the refrigerator 1 including the partitioned heater 201 performs partial defrosting, accumulated energy consumption until in the fourth cycle is about 153 WH. In other words, by performing both partial defrosting and full defrosting with the partitioned heater 201, the refrigerator 1 may have 26% of accumulated energy saving effect as compared with the conventional refrigerator.

Figure 13A:
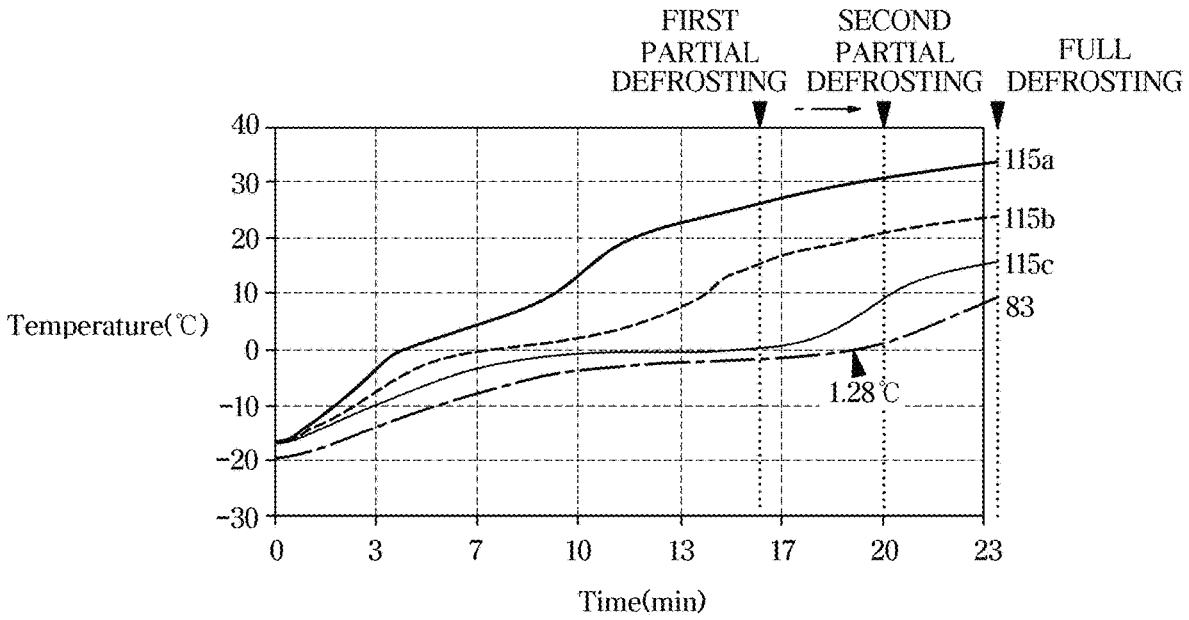
FIG. 13A illustrates a graph for explaining a control method according to another embodiment of the disclosure.

FIG. 13A illustrates a graph for explaining a control method according to another embodiment of the disclosure, and FIG. 13B is a table for explaining effects gained by performing the control method, according to another embodiment of the disclosure.

Referring to FIG. 13A, in an embodiment of the disclosure, the refrigerator 1 may have a different defrost completion time for each defrost cycle that performs partial defrosting. The refrigerator 1 sets the defrost completion time of a defrost cycle that performs partial defrosting to be about 16 minutes. However, in another embodiment of the disclosure, the refrigerator 1 may set a measurement of the defrost temperature sensor 83 to 1.28 degrees and change the defrost completion time to be about 20 minutes for the partial defrosting.

FIG. 13B illustrates an energy saving effect for each cycle that performs full defrosting with changing defrost completion time in another embodiment of the disclosure.

For example, when the defrost heater 200 is located in the bottom area 115*a* of the evaporator 100, the average temperature in the top area 115*c* is proportional to the defrost completion time. However, the energy saving effect is reduced according to the defrost completion time.

Even the refrigerator 1 having the defrost heater 200 located in the bottom area 115*a* of the evaporator 100 may be able to perform defrosting at room temperature even for the top area 115*c* of the evaporator 100 as well as have a similar energy saving effect when the refrigerator 1 properly controls the periodicity of full defrosting and the defrost completion time.

In another example, it may also be understood that the refrigerator 1 with the partitioned heater 201 may gain a high energy saving effect when properly controlling the defrost completion time of partial defrosting and the periodicity of full defrosting.

As described above, the refrigerator 1 according to embodiments of the disclosure may gain higher energy efficiency than the conventional refrigerator performing normal defrosting operation, while having the same defrosting effect.

Figure 14:
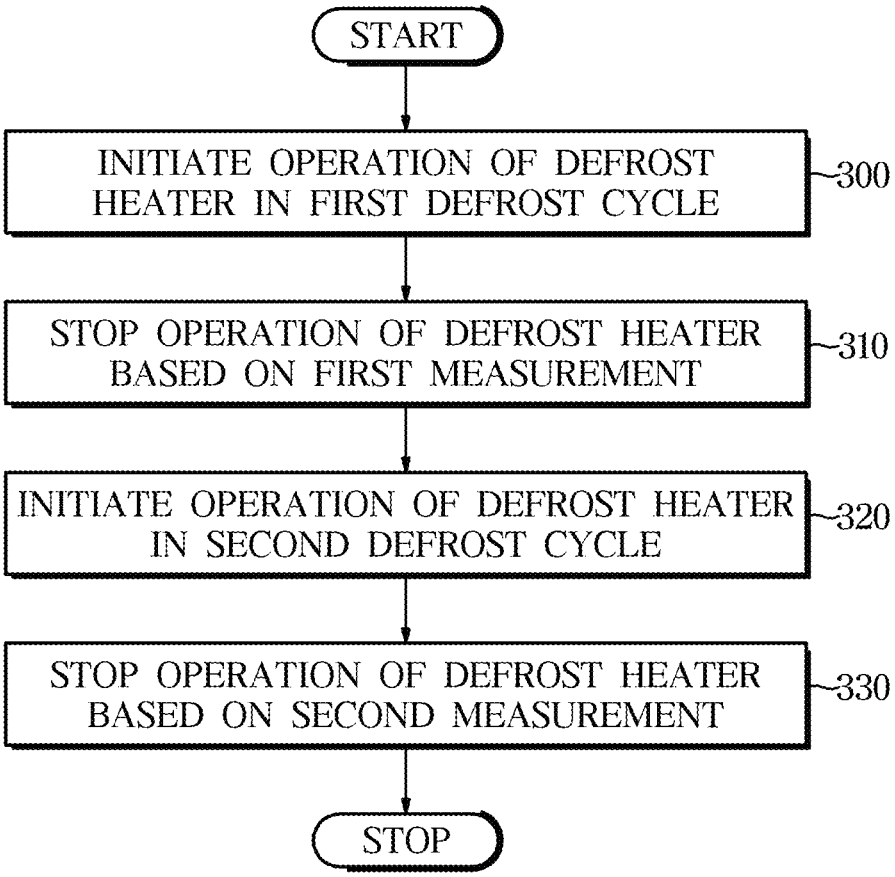
FIG. 14 is a flowchart illustrating a control method, according to an embodiment of the disclosure.

FIG. 14 is a flowchart illustrating a control method, according to an embodiment of the disclosure.

Referring to FIG. 14, in an embodiment of the disclosure, the controller 90 initiates operation of the defrost heater 200 in the first defrost cycle, in 310.

The operation of the defrost heater 200 is performed in the defrost cycle after cooling control is completed. The controller 90 monitors a temperature measurement collected by the defrost temperature sensor 83.

The controller 90 stops operation of the defrost heater 200 based on a first measurement, in 310.

The first measurement corresponds to a preset value for the defrost temperature sensor 83.

Specifically, when the first measurement is about 8.8 degrees and the defrost temperature sensor 83 sends its measurement, which is about 8.8 degrees, to the controller 90, the controller 90 stops operation of the defrost heater 200. When the operation of the defrost heater 200 is stopped, the first defrost cycle is stopped.

The controller 90 initiates operation of the defrost heater 200 in the second defrost cycle, in 330.

The second defrost cycle is initiated when a cooling cycle is completed after the first defrost cycle.

The controller 90 stops operation of the defrost heater 200 based on a second measurement, in 340.

The second measurement is another set temperature, different from the first measurement. For example, when partial defrosting is performed in the first defrost cycle, the controller 90 may perform full defrosting in the second defrost cycle. When the first measurement is about 8.8 degrees as in the previous example, the second measurement may be about −1 degree.

The controller 90 may increase defrost energy efficiency by performing defrosting based on different measurements of the defrost temperature sensor 83 in the first and second defrost cycles.

Figure 15:
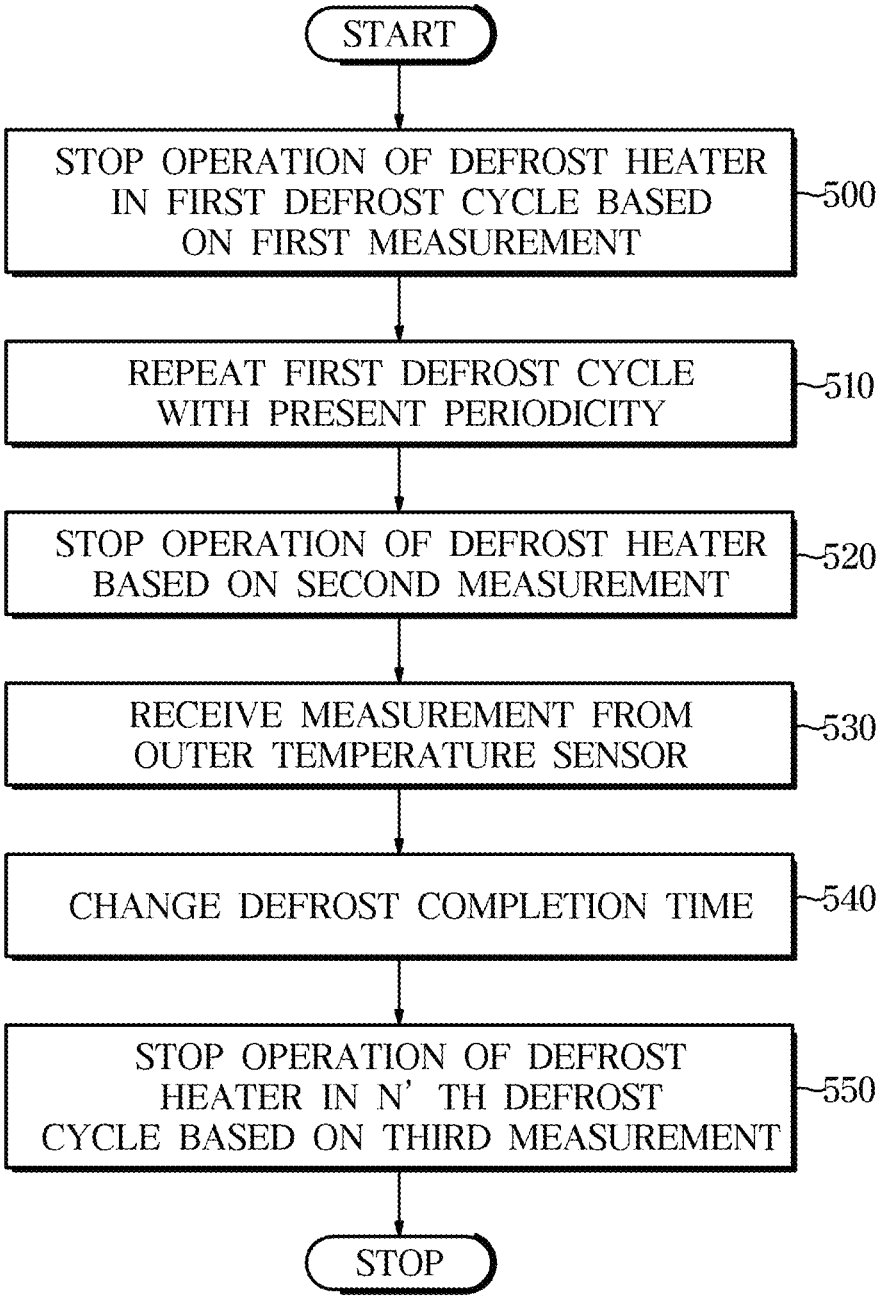
FIG. 15 is a flowchart illustrating a control method obtained by adding repetitive control to the control method of FIG. 14.

FIG. 15 is a flowchart illustrating a control method obtained by adding repetitive control to the control method of FIG. 14.

In this embodiment of the disclosure, the controller 90 initiates operation of the defrost heater 200 in 400, and stops operation of the defrost heater 200 based on the first measurement in 410.

As described above, the defrost heater 200 may be operated at a time when a cooling cycle is stopped. Furthermore, operation of the defrost heater 200 is stopped based on the preset measurement for the defrost temperature sensor 83, which completes the first defrost cycle.

The controller 90 may apply the first measurement-based defrost cycle equally to the subsequent defrost cycle.

The controller 90 compares the number of repetitions of the first measurement-based defrost cycle with preset periodicity, in 420.

Specifically, the controller 90 may set the number of repetitions of the first measurement-based defrost cycle in advance, and perform the defrost cycle repeatedly. When the number of repetitions of the defrost cycle is less than the preset periodicity, the controller 90 stops operation of the defrost heater 200 in the subsequent defrost cycle based on the first measurement again.

When the number of repetitions of the defrost cycle is greater than the preset periodicity, the controller 90 operates the defrost heater 200 in the subsequent defrost cycle in 430.

The controller 90 stops operation of the defrost heater 200 based on the second measurement, in 440.

The second measurement may be larger than the first measurement. For example, after a certain number of repetitions of the defrost cycle, the controller 90 may delay the defrost completion time of the defrost heater 200 in the subsequent defrost cycle.

Accordingly, the controller 90 may completely remove the frost in the top area 115*c* that might be left due to partial defrosting.

In some embodiments, the second measurement may not be greater than the first measurement. For example, the controller 90 may perform partial defrosting at preset intervals while repetitively performing full defrosting.

Figure 16:
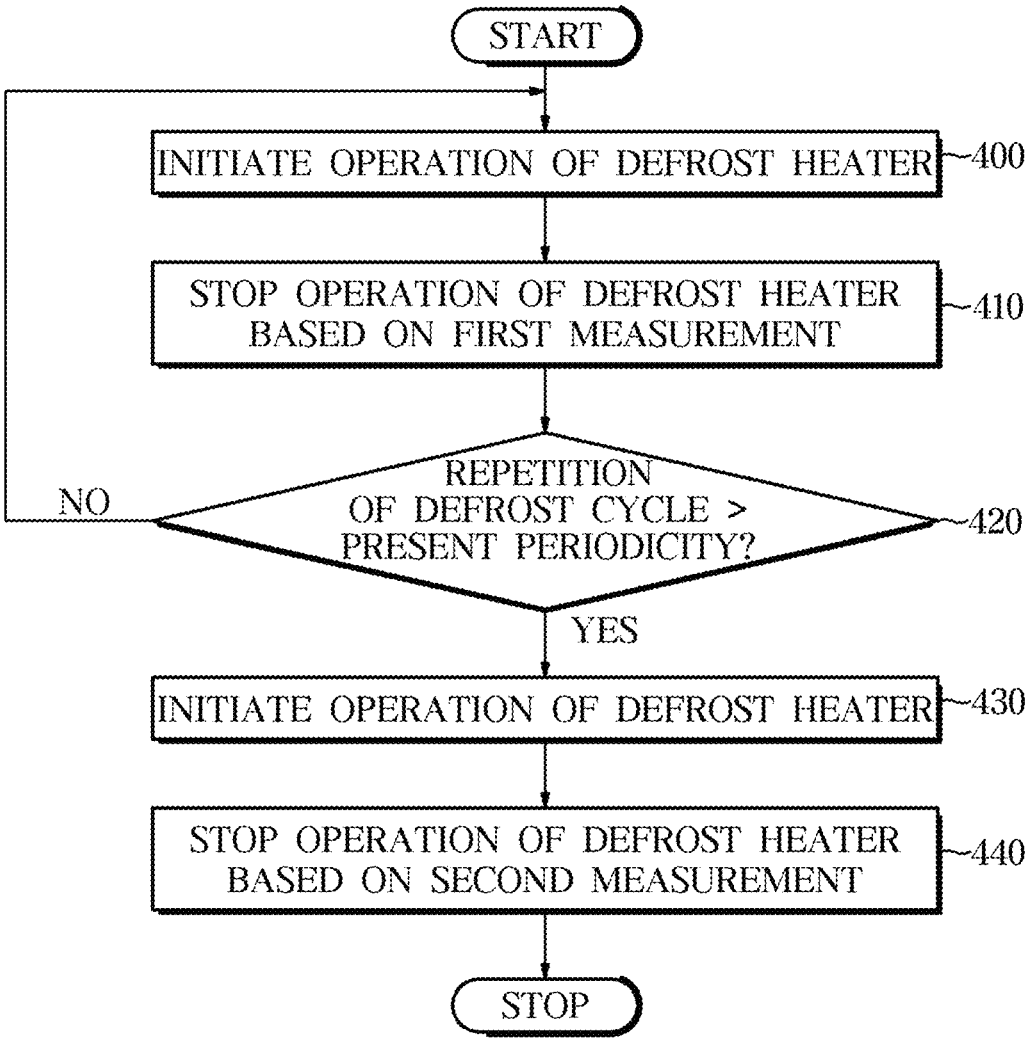
FIG. 16 is a flowchart illustrating a control method obtained by changing a measurement value in the control method of FIG. 15.

FIG. 16 is a flowchart illustrating a control method obtained by changing a measurement value in the control method of FIG. 15. Steps overlapping with those in FIG. 15 will be briefly described.

Referring to FIG. 16, in another embodiment of the disclosure, the controller 90 stops operation of the defrost heater 200 based on the first measurement in the first defrost cycle in 500, and repeats the first defrost cycle with preset periodicity in 510. In a defrost cycle beyond the preset periodicity, i.e., in the second defrost cycle, the controller 90 stops operation of the defrost heater 200 based on the second measurement, in 520.

The controller 900 controls the cooling module 50 during a cooling cycle after completion of the second defrost cycle. The controller 90 receives a measurement from the outer temperature sensor 82, in 530.

The controller 90 may determine that a temperature outside the refrigerator 1 is higher than usual based on a measurement of the outer temperature sensor 82. In this case, the controller may operate the cooling module 50 for a long time.

The controller 90 changes the defrost completion time, in 540.

As described above, when the cooling cycle is set to have long duration, more frost may be formed on the evaporator 100 than usual. Hence, the controller 90 may change the defrost completion time of the subsequent defrost cycle based on e. G., the duration of the cooling cycle.

When the change in defrost completion time is fixed, the controller 90 stops operation of the defrost heater 200 based on a third measurement of the defrost temperature sensor 83, in 550.

The third measurement may be applied in an $N^{th}$ defrost cycle. For example, the controller 90 may repeat the defrost cycle based on the second measurement and apply the third measurement in the subsequent defrost cycle after the change to the third measurement is fixed. Furthermore, the controller 90 may apply at least one of the first to third measurements in an $N+1^{th}$ defrost cycle after completion of the defrost cycle in which the third measurement is applied.

The refrigerator 1 divides the evaporator into areas in which frost or ice is formed in a defrost process using a sheath heater and efficiently performs defrosting for the areas, thereby reducing power consumption in the defrost process.

The refrigerator 1 may lower the temperature for defrosting heat used in a defrost process, increase cooling efficiency of the evaporator, and easily restore a target temperature required to maintain a temperature inside the storeroom, thereby reducing cooling energy required to control the refrigerator.

The refrigerator 1 may use only a sheath heater, thereby solving a problem arising in the conventional occasions of using both two types of heaters.

According to an embodiment of the disclosure, a refrigerator and control method thereof divides an evaporator into areas in which frost or ice is formed in a defrost process using a sheath heater and efficiently performs defrosting for the areas, thereby reducing power consumption in the defrost process.

According to another embodiment of the disclosure, a refrigerator and control method thereof may lower the temperature of defrosting heat used in a defrost process, increase cooling efficiency of an evaporator, and easily restore a target temperature required to maintain a temperature inside the storeroom, thereby reducing cooling energy required to control the refrigerator.

According to another embodiment of the disclosure, a refrigerator and control method thereof may use only a sheath heater, thereby solving a problem arising in the conventional occasions of using both two types of heaters.

Although the present disclosure has been described with various embodiments, various changes and modifications may be suggested to one skilled in the art. It is intended that the present disclosure encompass such changes and modifications as fall within the scope of the appended claims.

What is claimed is:

1. A refrigerator comprising:

a main body including a storeroom;

an evaporator arranged in a back of the storeroom, the evaporator configured to generate cold air;

a defrost heater arranged under the evaporator into which air flows, the defrost heater configured to remove frost or ice formed on the evaporator;

a temperature sensor arranged on a top of the evaporator, the temperature sensor configured to measure temperature;

a cooling module comprising a compressor, a condenser, the evaporator, and an expander; and a controller configured to:

perform a plurality of cooling cycles by controlling the cooling module;

perform one of a first defrost cycle or a second defrost cycle between each of the plurality of cooling cycles by operating the defrost heater;

stop operation of the defrost heater in the first defrost cycle in response to a first measurement, measured by the temperature sensor, being a first preset temperature; and stop operation of the defrost heater in the second defrost cycle in response to a second measurement, measured by the temperature sensor, being a second preset temperature, the second preset temperature being higher than the first preset temperature, wherein the controller is further configured to perform the second defrost cycle in response to the first defrost cycle being performed preset multiple times, and perform the first defrost cycle the preset multiple times in response to the second defrost cycle being performed once.

2. The refrigerator of claim 1, wherein the controller is further configured to change the preset multiple times.

3. The refrigerator of claim 1, wherein the defrost heater comprises a sheath heater, the sheath heater including a pipe producing heat, wherein the pipe is located under the evaporator.

4. The refrigerator of claim 1, wherein the defrost heater comprises:

a first pipe producing heat, the first pipe located under the evaporator; and a second pipe banded from the first pipe, the second pipe connected parallel to a heat exchange tube, the second pipe located in a center area of the evaporator.

5. A control method of a refrigerator, the method comprising:

performing a plurality of cooling cycles by controlling a cooling module comprising a compressor, a condenser, an evaporator, and an expander;

performing one of a first defrost cycle or a second defrost cycle between each of the plurality of cooling cycles by operating a defrost heater arranged under the evaporator into which air flows;

stopping operation of the defrost heater in the first defrost cycle in response to a first measurement, measured by a temperature sensor, being a first preset temperature; and stopping operation of the defrost heater in the second defrost cycle in response to a second measurement, measured by the temperature sensor, corresponding to a second preset temperature, the second preset temperature being higher than the first preset temperature, wherein the performing one of the first defrost cycle or the second defrost cycle comprises performing the second defrost cycle in response to the first defrost cycle being performed preset multiple times, and performing the first defrost cycle the preset multiple times in response to the second defrost cycle being performed once.

6. The control method of claim 5, further comprising changing the preset multiple times.

7. The control method of claim 5, wherein the defrost heater comprises a first pipe producing heat, the first pipe located under the evaporator.

8. The control method of claim 7, wherein the defrost heater further comprises a second pipe banded from the first pipe, the second pipe connected parallel to a heat exchange tube, the second pipe located in a center area of the evaporator.

9. A refrigerator comprising:

a main body including a storeroom;

an evaporator arranged in a back of the storeroom, the evaporator configured to generate cold air;

a defrost heater arranged under the evaporator into which air flows, the defrost heater configured to remove frost or ice formed on the evaporator;

a first temperature sensor arranged on a top of the evaporator;

a second temperature sensor arranged in a center area of the evaporator;

a cooling module comprising a compressor, a condenser, the evaporator, and an expander; and a controller configured to:

perform a plurality of cooling cycles by controlling the cooling module;

perform one of a first defrost cycle or a second defrost cycle between each of the plurality of cooling cycles by operating the defrost heater;

stop operation of the defrost heater in the first defrost cycle in response to a first measurement measured by the first temperature sensor being a first temperature; and stop operation of the defrost heater in the second defrost cycle in response to a second measurement measured by the second temperature sensor being a second temperature, wherein the controller is further configured to perform the second defrost cycle in response to the first defrost cycle being performed preset multiple times, and perform the first defrost cycle the preset multiple times in response to the second defrost cycle being performed once.

* * * * *